US005845986A

United States Patent [19]

Breen

[11] Patent Number: 5,845,986

[45] Date of Patent: Dec. 8, 1998

[54] LIGHT FOR MANUAL ROTARY TOOL

[76] Inventor: William Charles Breen, 915 Mull Ave. Suite K-1, Akron, Ohio 44313

[21] Appl. No.: 911,615

[22] Filed: Aug. 15, 1997

Related U.S. Application Data

[63] Continuation-in-part of Ser. No. 718,812, Sep. 24, 1996, abandoned.

[51] Int. Cl.[6] ..... B25B 23/18

[52] U.S. Cl. ..... 362/119; 362/120

[58] Field of Search ..... 362/455, 119, 362/120, 196, 118, 800, 184, 189, 109, 191, 255, 102; 359/800, 801, 802, 803

[56] References Cited

U.S. PATENT DOCUMENTS

| | | | |
|---|---|---|---|
| 1,274,022 | 7/1918 | Edmundson | 362/118 |
| 2,240,596 | 5/1941 | White et al. | 362/120 |
| 3,655,960 | 4/1972 | Andree | 362/119 |
| 3,919,541 | 11/1975 | Chao | 362/120 |
| 4,480,295 | 10/1984 | Shuster | 362/119 |
| 5,124,893 | 6/1992 | Jeng | 362/120 |
| 5,309,279 | 5/1994 | Halstead | 359/442 |
| 5,510,962 | 4/1996 | Hsiao | 362/120 |

*Primary Examiner*—James C. Yeung
*Attorney, Agent, or Firm*—Oldham & Oldham Co., LPA

[57] ABSTRACT

An illuminating device is provided for placement on a shaft of a manual rotary hand tool having a handle at a first end thereof and a workpiece-engaging adaptation at a second end thereof. The device has a body with a central aperture therethrough, at least one light source, an energy source for causing the light source to be illuminated and a switch to selectively connect or disconnect the energy source from the light source. The central aperture has an inner diameter adapted to permit the body to slide freely on the shaft. The at least one light source is aimed in the body to direct the light provided essentially coaxially with the central aperture to the workpiece-engaging shaft end. In preferred embodiments, the device uses at least two light sources. In some embodiments, an annular lens/reflector may be used to enhance the illumination.

14 Claims, 3 Drawing Sheets

LIGHT FOR MANUAL ROTARY TOOL

This application is a continuation-in-part of application Ser. No. 08/718,812, filed on 24 Sep. 1996, abandoned.

LIGHT FOR MANUAL ROTARY TOOL

The present invention relates to a portable lighting device which provides a beam of light for coaxial mounting on a tool with an axial shaft, such as a screwdriver, a nutdriver, or the like. In such a device, the light is provided along an axis generally coaxial with the shaft. In some embodiments, a magnification or reflectance adaptation is also provided.

BACKGROUND OF THE ART

Hand tools are often used by necessity in confined quarters where lighting of the workpiece is limited. In such cases, it is desirable to project a light beam axially along the shaft of the hand tool towards the end of the shaft away from the handle, at which end a workpiece-engaging adaptation, such as a screwdriver head, has been affixed. In such situations, it is inconvenient for the user to hold the hand tool in one hand and a standard flashlight in the other hand. It is also economically disadvantageous to provide each and every hand tool with a permanently-affixed light source, particularly when a user will need to carry several different tools.

SUMMARY OF THE INVENTION

It is, therefore, an object of the present invention is to provide a device for illuminating a workpiece-engaging adaptation of a hand tool, particularly a rotary hand tool, with a shaft having a handle at a first end thereof and the workpiece-engaging adaptation at a second end thereof. Such a device comprises a body with at least one light source disposed in the body, along with an energy source communicated to each of the at least one light sources to cause illumination of the light source and a switch for selectively connecting and disconnecting the energy source from the light source. The body has a central aperture therethrough with an inner diameter adapted to permit the body to slide freely on the shaft of the tool. Each of the at least one light sources is aimed so as to direct the light provided essentially coaxially with the central aperture. In use, the device is secured, preferably frictionally, to the shaft in a selected position, but the device is easily removable from the shaft.

In some embodiments, the body is provided with an annular lens for magnifying the work area, and in some cases, the lens is partially silvered to reflect light back towards the work area. The preferred embodiments of the device have at least two light sources and the light sources are distributed around the circumference of the central aperture so as to minimize "blind spots" caused by the shaft in lighting the work area.

BRIEF DESCRIPTION OF THE DRAWINGS

These and other objects of the present invention will be best understood when reference is made to the accompanying drawings, wherein identical parts are indicated by identical part numbers and wherein.

DETAILED DESCRIPTION OF THE PREFERRED EMBODIMENT

Figure 1:
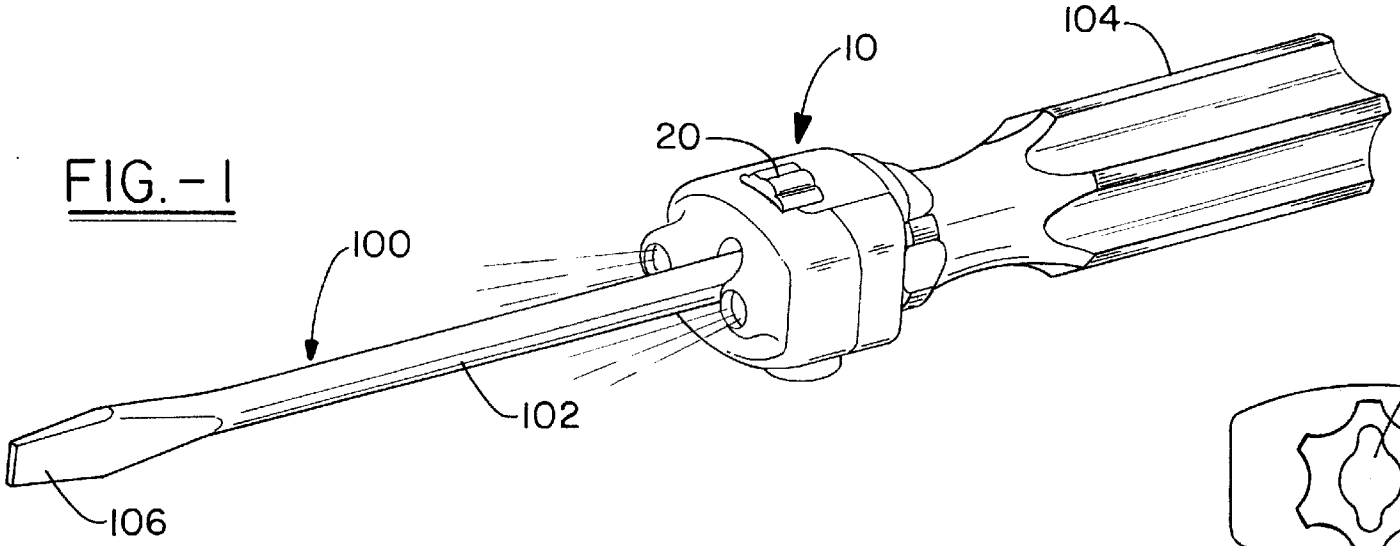
FIG. 1 shows a perspective view of the device as it may be applied to a screwdriver.
Figure 4:
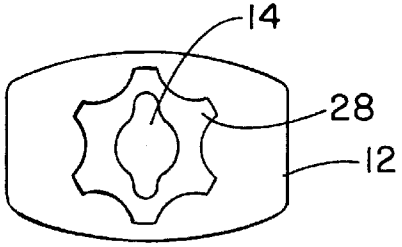
FIG. 4 is a rear view.
Figure 8:
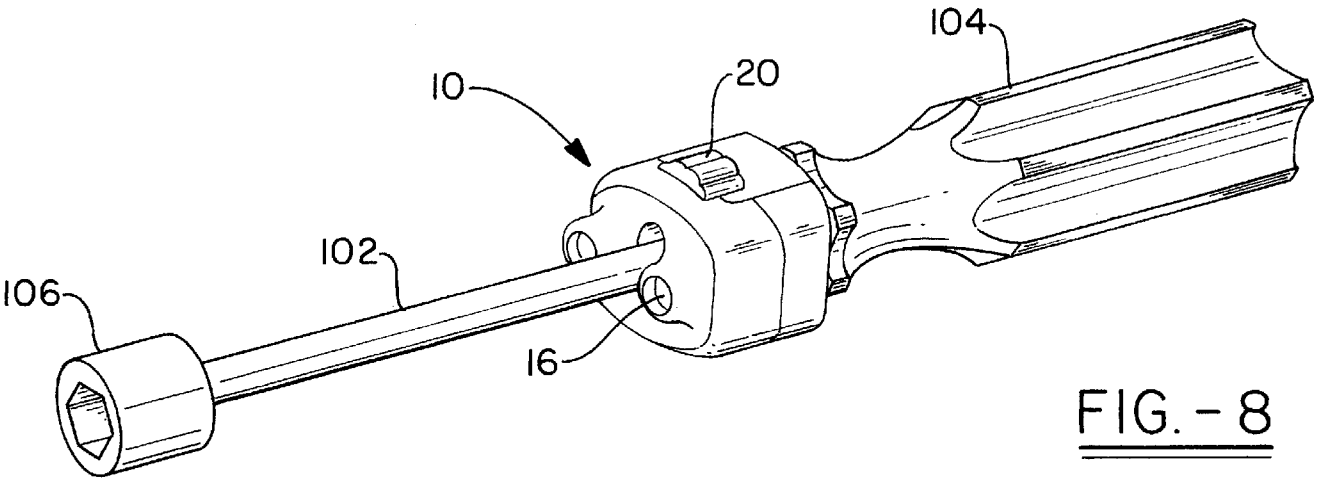
FIG. 8 is a perspective view of the device in use with a nutdriver.

A standard rotary hand tool 100 of the type commonly referred to as a screwdriver or a nutdriver has a shaft or shank 102 providing an axis with a pair of ends. Such devices are shown in FIGS. 1 and 8, with the device of the present invention applied thereon. A handle or gripping means 104 is provided at a first end of the shaft 102, and a workpiece-engaging adaptation 106 is provided at the second end. The type of tool is determined by the specific workpiece-engaging adaptation selected. For example, a flat blade end adaptation is generally referred to a "screwdriver", but other end configurations result in the tools referred to as a "Phillips-head screwdriver", a "socket-head screwdriver" or a "hexhead nutdriver", just to name a few of the possible variations. In some of these variations, the end adaptation 106 has an effective diameter which is larger than that of the shaft 102, so simply sliding something onto the shaft over the adaptation 106 and expecting it to be frictionally securable to the shaft is not possible. To achieve the desired mechanical advantage, the handle 104 always has a larger diameter than the shaft 102. Although it is known in some cases to make the junction of the shaft with the handle one that permits interchange of shafts in a single handle, it is much more common to permanently affix a shaft into a handle, largely due to the fact that this junction is a point of high stress because of the torque transfer which occurs in use.

As shown in the several drawings, the preferred device 10 of the present invention has a body 12, the primary structural feature of which is a central aperture 14, about the axis of which the body will generally exhibit symmetry in the preferred embodiments. The preference for symmetry suggests use of a toroidal or ring-shaped body, although other designs are certainly possible. The central aperture 14 will have an inner diameter sufficiently large to allow the body 12 to slide freely onto the shaft 102 of the tool 100 on which it is to be used, even over a workpiece-engaging adaptation 106 which is larger than the shaft. Once positioned on the shaft 102 of a tool 100, the axis of the body 12 will be generally aligned with the axis of the shaft.

Figure 5:
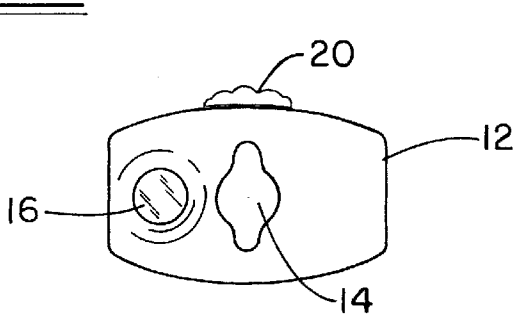
FIG. 5 is a front view of a single light source device.

Disposed in the body is at least one light source 16, as shown in FIG. 5. Each of the light sources 16 so used is positioned on the body so that the light it provides is directed essentially coaxially with the central aperture 14 towards the workpiece-engaging end of the shaft 102. Use of a single light source 16 will provide an operable embodiment, but the clearly preferred embodiments will provide two or more light sources 16, as is shown in FIGS. 1–3 and 8. This is for at least two reasons. First, the proximity of the light source 16 to the shaft 102 means that the shaft blocks off light from reaching the work area at the workpiece-engaging end. Second, the preferred embodiment of the invention is to provide a device in which the light sources are not easily replaced. Although a "long life" light source should be selected, a device having at least two light sources remains operable if one of the at least two light sources fails prematurely, but a device having only one light source is no longer operable if the single light source fails. The prime considerations in selecting the exact light source include the following: size; power consumption, intensity of light provided, and reliability or expected life, and cost. For these reasons, the preferred presently available commercial light source is a high-intensity light-emitting diode (LED). Such a light source is preferably permanently mounted in the body in a face of the body surrounding the central aperture. The light provided by the light source 16 should be directed generally coaxially with the axis of the central aperture 14 so that a point along the shaft 102 located from a few inches to about a foot away from the light source is illuminated. When two or more light sources 16 are used, they should be evenly distributed around the periphery of the central aperture, thereby minimizing the shadow of the shaft 102 onto the work area. Two light sources 16 would be preferably located 180 degrees apart from each other; three light sources would preferably be 120 degrees apart, and so on.

Figure 2:
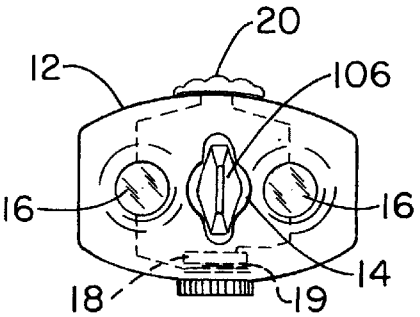
FIG. 2 is a front view of a first embodiment of the device having two light sources.
Figure 7:
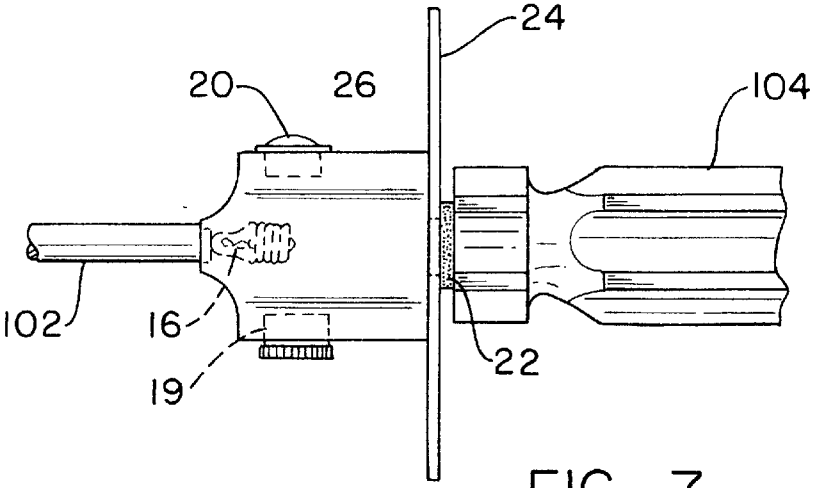
FIG. 7 is a partial side view with a reflective disk mounted behind the device for enhanced illumination.
Figure 6:
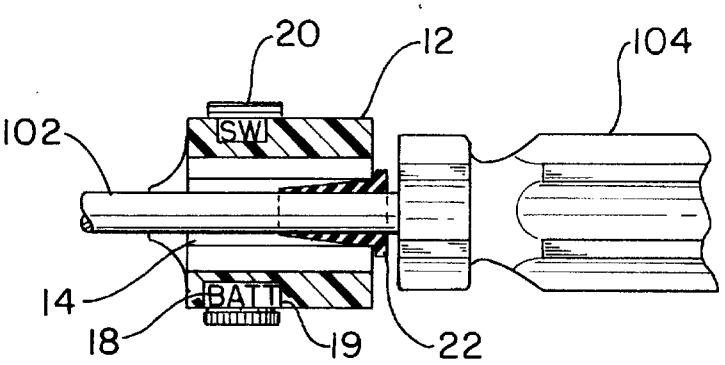
FIG. 6 is a partial side view of one embodiment of the device with portions broken away.

Also disposed in the body 12 is at least one energy source 18, as is shown in FIG. 2 and 6. Each energy source 18 provided is communicated to at least one of the light sources 16 so that each of the light sources provided may be sufficiently powered to cause the illumination thereof. The preferred energy source 18 is a chemical battery cell, particularly a "button-type" cell as would be used in a small device such as a watch, a calculator, a camera, or the like. These cells typically provide 1–3 volts of power and the cells may be connected in series to provide additive voltage. The exact selection of the energy source 18 will be apparent once the light source 16 is selected. Unlike the light sources 16, the energy sources 18 are expected to be depleted during use. For that reason, the body should be provided with means for accessing and replacing the energy source, such as the covered recess 19 shown in FIGS. 2 and 6.

Figure 3:
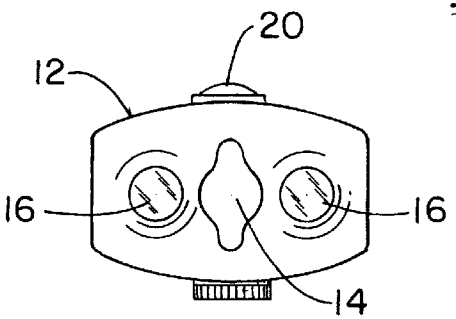
FIG. 3 is a front view of a second embodiment of the device with only one light source.

The body 12 must also contain a switch 20 or other means for selectively connecting and disconnecting the communication of each at least one light source from its energy source. If the switch 20 is located on the exterior of the body 12, the type of switch 20 may be of a variety of types, since a variety of small, reliable inexpensive switches are commercially available for handling the voltage and wattage involved in this application. Two such different types of switches 20 are shown in FIGS. 2 and 3, the switch 20 in FIGS. 1 and 2 being a slide-type switch and the switch 20 in FIG. 3 being a push-button type switch. A variation on the preferred scheme of the present invention is to provide the interior of the central aperture 14 with opposed electrical contact means, so that an electrically-conductive shaft 102 of the tool 100 acts between the contacts to make a circuit. The mere act of placing the body 12 onto the shaft 102 of such a tool 100 causes the circuit to be made and the light sources to be activated.

Since the device 10 of the present invention has a central aperture 14 with an inner diameter large enough to permit the device to slide freely on the shaft 102, and to be able to be passed over the workpiece-engaging adaptation 106 at one end of the shaft, it is necessary to provide a means for securing the device to the shaft 102 so that it is held in place while the tool 100 is being used. The preferred method of doing this is to provide a collar 22, as shown in FIG. 6, which may be placed between the shaft 102 and the device 10, with the collar having an inner surface for frictionally engaging the shaft and an outer surface for frictionally engaging the inner diameter of the 14 central aperture in the device. A preferred manner of accomplishing this is with a collar 22 formed from an elastomeric material, especially a collar having a longitudinal axial split, which permits easy placement of the collar on the shaft 102 without requiring it to pass over the workpiece-engaging adaptation 106. In another embodiment, the securing means could be a plurality of stiff bristles directed radially inwardly from the central aperture and affixed therein. Such bristles would be deflectable to allow passage over the workpiece-engaging adaptation, but would frictionally secure the device to the shaft. If the bristles were used, were electrically-conductive, and the shaft was electrically-conductive, then these could provide the proposed electrical contact means for contact with the shaft as described above.

In some embodiments of the present invention, it may be desirable to further provide the device with a lens means or a reflectance means, or a combination of the two, secured to the body and radially extending outwardly therefrom. Such a lens or reflector 24 would typically be a relatively thin piece of material, preferably polymeric (if a lens) or possibly metallic (if a reflector only), with a central aperture 26 of at least the same inner diameter as the central aperture 14 of the body 10. The radius of the lens/reflector 24 should be at least about 0.5 inches (1.27 cm) larger than the radius of the body 10, so that the edges extend radially outwardly therefrom when the lens/reflector and body are placed in proximity. This lens/reflector 24 may be a clear plastic material molded to act as a Fresnel lens in one embodiment, or formed in a concave fashion to act as a focusing reflector, among other possibilities. If the lens/reflector 24 is intended to serve both purposes, at least one of the generally planar surfaces of the lens/reflector may be coated with a silvering or reflective material so that the lens/reflector acts as a one-way mirror. The lens/reflector 24 may be attached directly to the body 10 or to the collar 22 holding the body to the shaft 102. In the first case, the body 10 may have an elastomeric flange attached around its central aperture 14, upon which the central aperture 26 of the lens/reflector may be seated. In the second case, the central aperture 26 of the lens/reflector engages the collar 22 frictionally in the same manner as the central aperture 14 of the body 10 does.

In yet another variation encompassed within the present invention, the body 10 has a central aperture 14, however the central aperture is smaller, for frictionally engaging the shaft directly. To enable the body 10 to be placed upon the medial portion of the shaft without having to pass over the workpiece-engaging adaptation 106, the body should be formed from an elastomeric material which may be deformed. A particular embodiment of this device would have a longitudinal axial split similar to that in the collar 22 described above, so that the split may be opened for placement around the shaft, after which the body would be frictionally held to the shaft.

In some embodiments of the present invention, the body 10 may have body modifications directed specifically at adapting the body to work better with a specific tool. For example, the handle 104 of the tool 100 often has a fluted end. If the rear surface of the body 10 surrounding the central aperture 14 is provided with a similarly fluted recess 28, this may assist in securing the body to the shaft 102 in a non-rotating manner.

Figure 9:
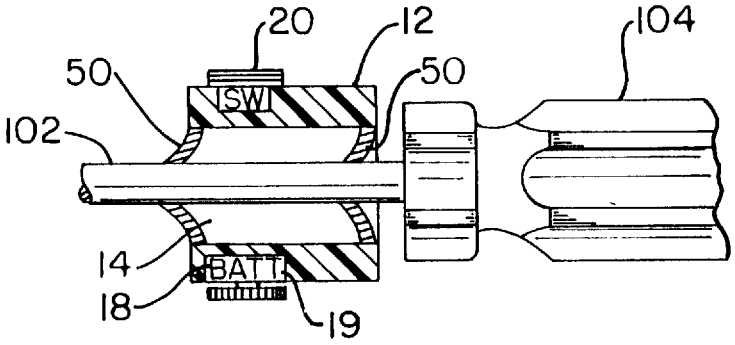
FIG. 9 is a partial side view of a second embodiment of the device with portions broken away.

In the embodiment of the invention as shown in FIG. 9, the means for frictionally securing the body 10 to the shaft

Figure 10:
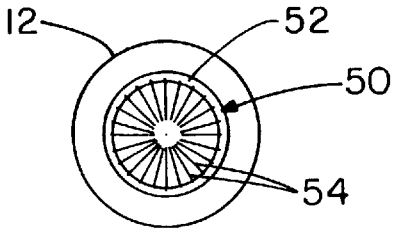
FIG. 10 is an enlarged front view of a first embodiment of element 50 which is shown in side view in FIG. 9.
Figure 11:
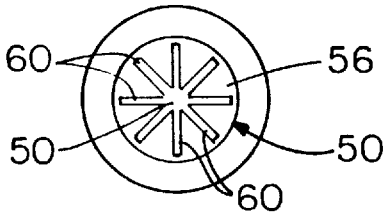
FIG. 11 is an enlarged front view of a second embodiment of element 50 which is shown in side view in FIG. 9.

102 is a first and a second electrically conductive deflectable element 50, each of which is in electrical contact with the shaft. Further, the pair of electrically conductive deflectable elements 50 are a part of the electrical circuitry of the device including the switch 20 and the battery 18 so that a complete electrical circuit can be formed only when the elements 50 are each in contact with an electrically conductive material such as the shaft 102. In other words, the device will automatically turn itself off when removed from the shaft 102, thereby prolonging battery life. Of course, with the switch in place, the device may be turned off while still being mounted on an electrically conductive shaft. In FIG. 10, a first variation of an element 50 is shown as a ring 52 having a plurality of inwardly radially extending bristles 54, which are electrically conductive. In FIG. 11, a second variation of element 50 is shown as a disc 56, preferably of spring steel or the like, having an axial aperture 58 acting as the origin of a plurality of outwardly extending radial cuts 60 which terminate short of the periphery of the disc. These radial cuts 60 effectively divide the disc 56 into a plurality of wedge-shaped pieces which are deflectable when the shaft is passed through the axial aperture 58.

Although the device of the present invention is described as being most commonly used in association with a rotary hand tool such as a screwdriver, it is clear that the desirability of providing a coaxial light source along other shafted tools provides incentive for variation. For example, a chisel is not used as a rotary-type of tool, but there is often a desire to light the work area. Non-manual tools, such as a powered screwdriver or drill will usually have sufficient power available to provide lighting from the main body of the device, if desired, so the present device would not usually be used in association with them in most cases.

What is claimed is:

1. In combination with a manual rotary hand tool having a shaft of an electrically conductive material with a handle at a first end of the shaft and a workpiece-engaging adaptation at a second end of the shaft, an improved device for illuminating the workpiece-engaging adaptation comprising:

a body having a central aperture therethrough, the central aperture having an inner diameter of sufficient size to slide freely on the shaft;

a pair of means for frictionally securing the body to the shaft at a selected point along the length thereof to prevent longitudinal movement therealong, the pair of means located along the central aperture;

at least one light source disposed in the body so as to direct the light provided thereby at the workpiece-engaging adaptation;

an energy source for each at least one light source, said energy source disposed in the body and communicated to the at least one light source to cause illumination of the at least one light source; and means for selectively connecting and disconnecting the communication of each at least one light source from its energy source, an electrical connection between the first and the second of the pair of the frictionally securing means using the electrically-conductive shaft comprising a portion of the selective connecting and disconnecting means.

2. The device of claim 1 wherein the at least one light source is a high-intensity light-emitting diode (LED).

3. The device of claim 2 wherein the energy source for each at least one light source is a button-type electrical battery.

4. The device of claim 1 wherein the at least one light source comprises two light sources.

5. The device of claim 4 wherein the light sources are evenly distributed around the circumference of the central aperture.

6. The device of claim 1 wherein the means for selective connecting and disconnecting further comprises a switch mounted on the body.

7. The device of claim 1 wherein each of the pair of means for frictionally securing comprises a plurality of stiff bristles directed radially inwardly from the central aperture and in deflectable electrical contact with the shaft.

8. The device of claim 1 wherein each of the pair of means for frictionally securing comprises a plate of spring steel with a axial aperture and having a plurality of radial cuts emanating from the axial aperture to provide deflectable electrical contact with the shaft.

9. The device of claim 1 where in the device further comprises an annular lens secured coaxially on the shaft by the body.

10. The device of claim 9, wherein a surface of the annular lens is coated with reflective material.

11. The device of claim 9, wherein the annular lens is attached to an end of the body.

12. The device of claim 9 wherein the annular lens is secured between the body and an elastomeric collar having an elastomeric longitudinal split.

13. The device of claim 1 wherein a rear surface of the body surrounding the central aperture is shaped in a complementary fashion to the handle to assist in securing the body to the shaft in a non-rotating manner.

14. In combination with a manual rotary hand tool having a shaft with a handle at a first end of the shaft and a workpiece-engaging adaptation at a second end of the shaft, an improved device for illuminating the workpiece-engaging adaptation comprising:

a body having a central aperture therethrough, the central aperture having an inner diameter of sufficient size to slide freely on the shaft, the body having a a rear surface surrounding the central aperture which is adapted and sized to receive the handle in a complementary fashion to assist in securing the body to the shaft in a non-rotating manner;

a pair of means for frictionally securing the body to the shaft at a selected point along the length thereof to prevent longitudinal movement therealong, the pair of means located along the central aperture;

at least one light source disposed in the body so as to direct the light provided thereby at the workpiece-engaging adaptation;

an energy source for each at least one light source, said energy source disposed in the body and communicated to the at least one light source to cause illumination of the at least one light source; and means for selectively connecting and disconnecting the communication of each at least one light source from its energy source.

* * * * *